US005188486A

United States Patent [19]

Rhodes et al.

[11] Patent Number: 5,188,486

[45] Date of Patent: Feb. 23, 1993

[54] QUIK-LOC END ARRANGEMENT FOR PNEUMATIC OUTLET GATES

[76] Inventors: Wayne A. Rhodes, Rte. 1, Box 43, Luray, Tenn. 38352; James W. Johnson, 151 Claiborne Dr., Jackson, both of Tenn. 38305

[21] Appl. No.: 882,074

[22] Filed: May 12, 1992

[51] Int. Cl.[5] ..... B65G 53/24; B65G 53/46

[52] U.S. Cl. ..... 406/145; 406/130; 222/153

[58] Field of Search ..... 406/145, 128, 129, 130; 222/153

[56] References Cited

U.S. PATENT DOCUMENTS

| | | | |
|---|---|---|---|
| 3,048,448 | 8/1960 | Aller | 302/52 |
| 3,050,342 | 5/1960 | Koranda et al. | 302/52 |
| 3,088,778 | 5/1963 | Aller | 302/52 |
| 3,194,420 | 4/1964 | Kemp et al. | 214/83.28 |
| 3,627,383 | 12/1969 | Adler | 302/52 |
| 3,637,262 | 1/1972 | Adler | 406/145 X |
| 3,693,839 | 9/1972 | Shaver et al. | 406/128 |
| 3,693,846 | 9/1972 | Schuller | 406/145 X |
| 3,715,053 | 2/1973 | Carter | 406/145 |
| 3,797,891 | 3/1974 | Fritz | 302/52 |
| 4,082,365 | 4/1978 | Dugge et al. | 406/129 |
| 4,114,785 | 9/1978 | Dugge | 406/128 X |
| 4,151,935 | 5/1979 | Dugge | 222/556 |
| 4,345,859 | 8/1982 | Robertson | 406/145 X |
| 4,397,591 | 8/1983 | Carney et al. | 406/131 |
| 4,411,560 | 10/1983 | McComb | 406/128 |
| 4,695,207 | 9/1987 | Miller | 406/130 |
| 4,867,615 | 9/1989 | Fritz | 406/128 |
| 4,934,877 | 6/1990 | Haverick et al. | 406/128 |
| 4,974,999 | 12/1990 | Fritz et al. | 406/145 |
| 4,975,000 | 12/1990 | Fritz et al. | 406/145 |
| 5,060,579 | 10/1991 | Johnson et al. | 105/282.2 |

*Primary Examiner*—Johnny D. Cherry
*Assistant Examiner*—James M. Kannofsky
*Attorney, Agent, or Firm*—Head & Johnson

[57] ABSTRACT

Rail hopper cars have loading gates which is a way of controlling the flow of material that is in hopper cars out through a connection tube. There are control rods for opening and closing the loading gate. There is an end cap that fits over the open end of the connection tube. The cap, in the present invention, has outwardly extending radially spaced locking lugs each having a locking convex surface. A separate locking lug concave surface is positioned on each handle of the control rods for mating with the convex surfaces on the cap. When the end cap is placed over the tube and is rotated to a position where the locking convex surfaces are adjacent the locking lugs on the operating handles of the control rods, the control rod handles cannot turn. Also when in this position the locking lugs on the handles prevent the cap from being removed. A spring loaded locking lever on the end cap engages a locking slot on the end tube and prevents rotation of the end cap when it is positioned thereon. When it is desired to remove the end cap, the spring loaded locking lever is removed from the locking slot and the end cap rotated about 40 degrees to where the locking lugs thereon are out of alignment with the locking lugs on the control rod handles. The cap can be readily removed and the control rod handles are then operable.

6 Claims, 3 Drawing Sheets

QUIK-LOC END ARRANGEMENT FOR PNEUMATIC OUTLET GATES

BACKGROUND OF THE INVENTION

This invention relates to the end cap, the handles for control rods and the vacuum connection tube arrangement of unloading gates for rail hopper cars and trucks.

Railroad hopper cars and trucks are used to haul all sorts of cargo, such as pellets and the like. The bottom of the tank of such cars and trucks is provided with a trough that has V-shaped walls that make up the trough. At the apex of the trough there is a gate valve that is used to close off and prevent discharge of material from the V-shaped trough. This valve mechanism can be opened or closed from either end of the gate, that is, from either side of the hopper car, by rotating control rods with handles. A discharge tube is connected at each end of the gate. It is through this discharge or connection tube that the material is taken from the hopper. There are caps that close off the end of the discharge tube.

In the normal course of events, when the tank is empty it is desired to fill it with some material that normally can be in the form of plastic pellets or resins. Before the load is put into the hopper car an operator must close the valve mechanism in the gate. This is normally done by rotating knobs or handles attached to each end of the control rods that traverse the length of the gate. After the valves are closed, end caps are placed over the connection tubes at each end of the gate and locked in place. After locking the caps in place, a tamper seal is placed in some location that would prevent the caps from being moved without first removing the seals. This is to ensure to the customer that the product has not been removed or tampered with in any way during transit.

A typical tamper seal used on these gates includes a loop of aircraft type cable and a locking device that after the loop of the cable is passed through the component of the gate which locks the caps on and is pushed into a locking device on the cable that prevents the cable from releasing or otherwise damaging it.

When it is time to unload the hopper, the customer first inspects the tamper seal to see if it has been broken, which may indicate that the end cap has been removed and material taken from the hopper car. If there has been no tampering with the seal, the seals are broken by the customer and both end caps are removed and the hopper car can then be unloaded in a conventional manner.

SUMMARY OF THE INVENTION

A novel end cap for use with a hopper car functions not only to close a connection tube but also serves to prevent rotation of control rods that are operated to open and close a hopper gate valve mechanism. Material in the hopper is discharged through the connection tube. In this invention, the connection tube has a collar that is secured to the hopper car end panel. The end cap fits over this connection tube and when in a locked position functions not only to close the connection tube but also serves to prevent rotation of the control rods.

The cap has a pair of spaced apart locking lugs, each having a convex locking surface and a rim. Each control rod handle is provided with a locking means having (1) a concave locking surface and (2) a locking shoulder.

To place the cap on the tube, the cap is rotated to be out of alignment with the control handle locking lugs and then moved axially until it contacts a seal on the collar of the connection tube. The cap is then rotated so that its locking lugs engage the locking lugs of the handle. The mating of the handle concave locking surface and the convex locking surface of the cap locking lugs prevents the handle from rotating. Contact of the rim of the cap locking lug with the locking shoulder of the control rod handle prevents axial movement of the cap. The cap has a spring loaded lever that locks into a slot on the collar of the connection tube. This prevents rotation of the cap. To remove the cap, the operators lift the cap locking lever out of the collar slot. The cap is then rotated until its lugs disengage the locking lugs on the control rod handle. The cap is then removed by axial movement.

An object of this invention is to provide an improved end arrangement for unloading gates with rail hopper cars.

Another object is to provide an end cap for the connection tube, such as when in the locked position the cap functions both to close the connection tube and also serves to prevent rotation of the control rods.

A further object is to make the cap, locking device, connection collar, and handles integral components that interact with each other to provide essentially a fail-safe locking and operating system.

The principle object of the invention is to improve the quality and ease of operating the outlet gates.

These objects and a better understanding of the invention will be had from the following discussion in conjunction with the attached drawings.

DESCRIPTION OF THE INVENTION

Figure 1:
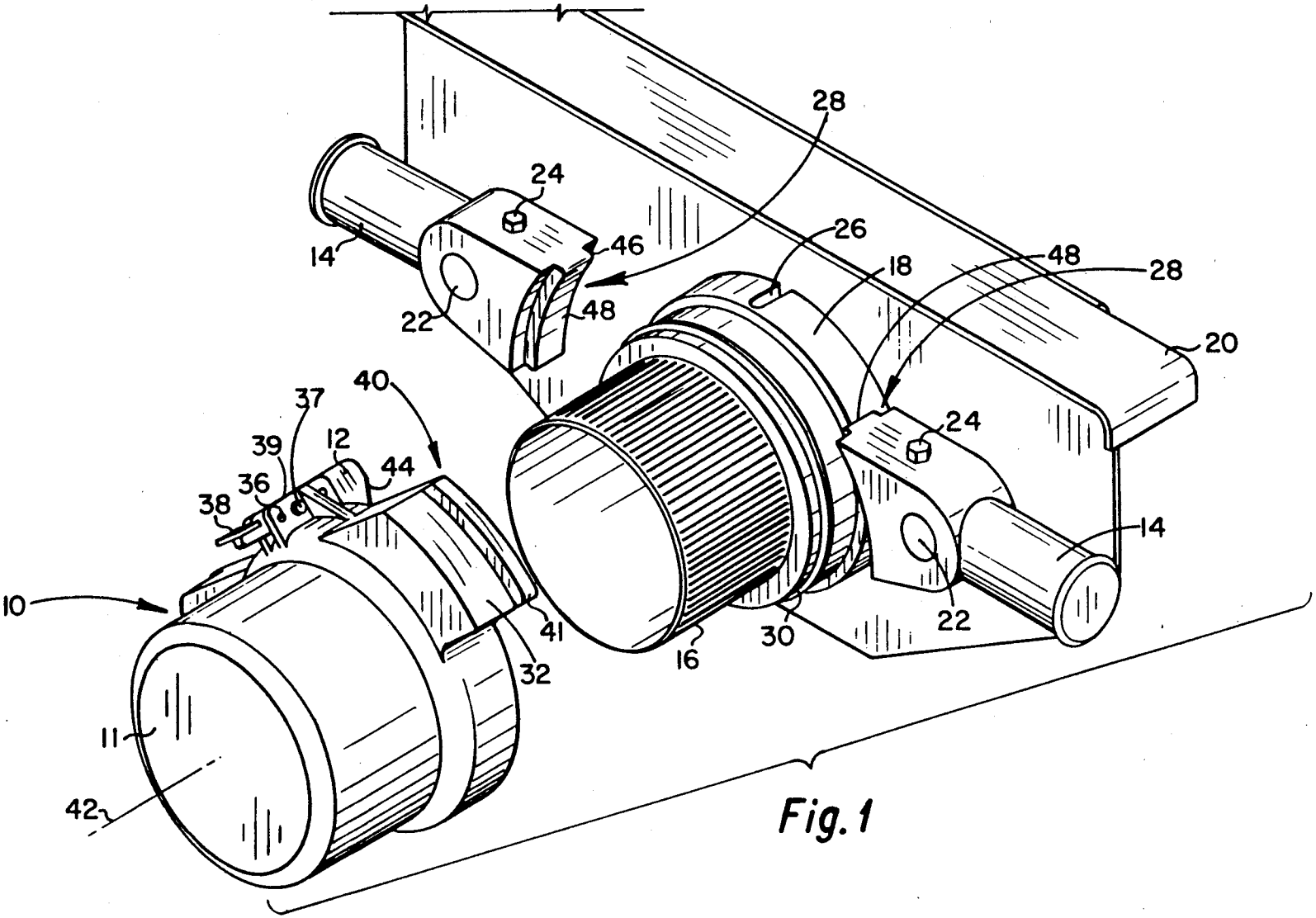
FIG. 1 is a front perspective view showing gate control rods extending through a hopper end panel, control rod handles, an end cap removed from the connection tube and connection tube collar that is attached to the end panel.

Attention is first directed to FIG. 1 that illustrates in perspective form an end panel 20 that is a part of a rail hopper car or other carrier. There is a connection tube 16 with connection tube collar 18 that is welded or otherwise secured to the operating end panel 20. There are two control rods 22 that extend through end panel 20. The control rods 22 each has an operating handle 14. Rotating handles 14 advances or retracts an associated gate valve to close or open the respective hopper discharge slots (not shown). For a complete description of a gate or valve mechanism of a hopper car, reference is made to U.S. Pat. No. 5,060,579 issued Oct. 29, 1991, to James W. Johnson et al. and is entitled "Sliding Hopper Outlet Gate With Plastic Upper Surface For Smooth Sliding And For Sealing The Outlet". Thus, using operating handles 14 to rotate control rod or shaft 22 opens or closes a valve mechanism whereby the pellets or other materials stored in the hopper can be removed through connection tube 16.

Figure 3:
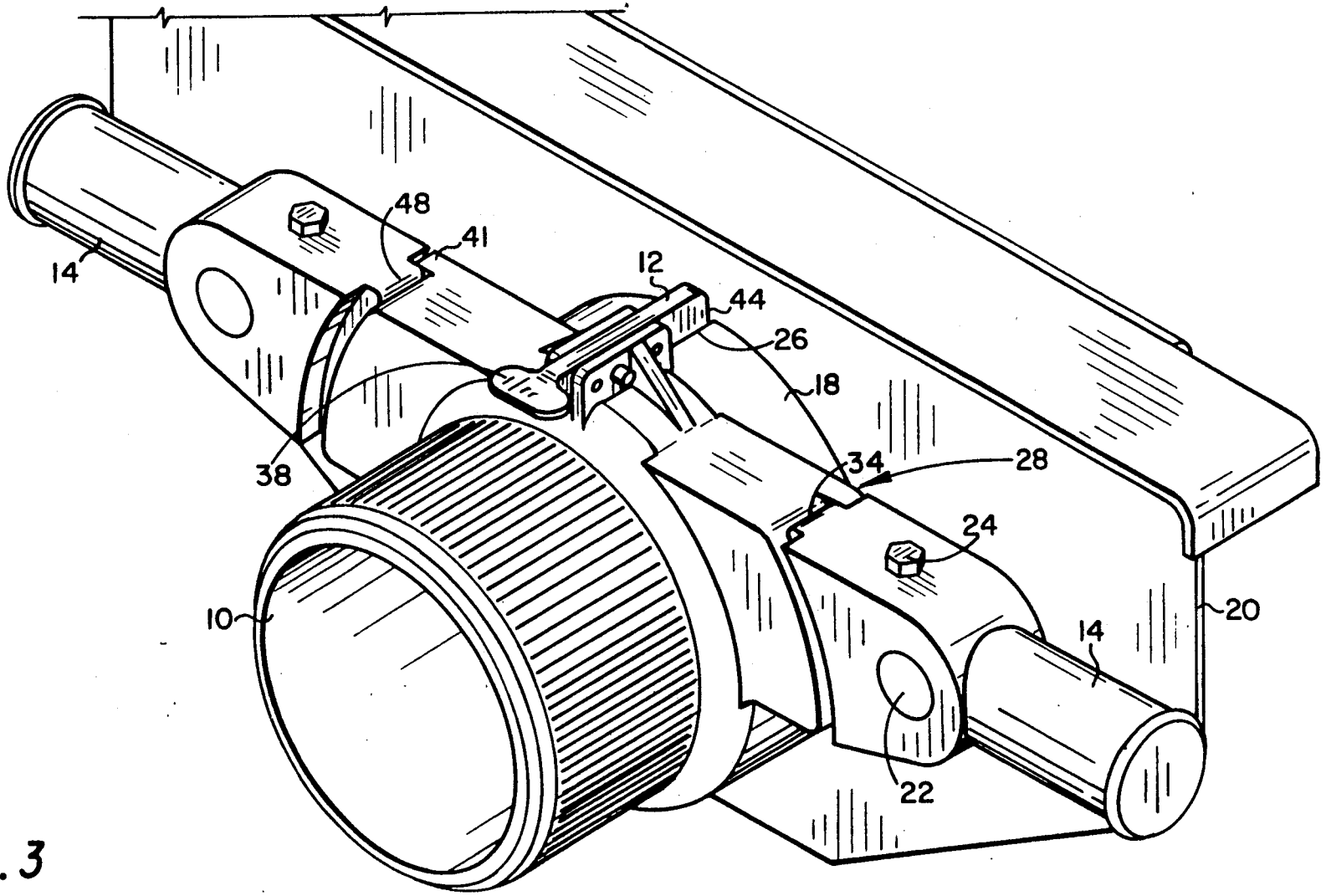
FIG. 3 is a front perspective view showing the end cap and operating handles of the gate in sealed and locked position.

We shall next discuss modifications to the connection tube end collar and to the operating handles together with a novel end cap, whereby when the end cap is in the locked position, as shown in FIG. 3, it functions not only to close the connection tube 16 but also serves to prevent rotation of the control rods.

The connection tube 16 is a hollow tube and is connected through end panel 20 to receive material from a hopper. Connection tube 16 has a connection tube collar 18 that is welded to end panel 20. A sealing ring 30 is provided on connection tube collar. End cap 10 has a solid end 11 and is of a size that will closely fit over connection tube 16. Sealing ring 30 will form a seal with the end of end cap 10 when it is extended over connection tube 16. As shown, end cap 10 has a pair of circumferentially spaced locking lugs 40, each lug has a raised or locking lug portion 41 and a locking convex surface 32 that is of a smaller diameter than locking lug rim 41. Surface 32 takes the form generally of an arc (segment of a cylinder) with the center being on an axial line 42 through end cap 10 and connection tube 16 when the two are axially aligned. End cap 10 also has a spring loaded locking lever 12 that has a head lug 44 and a finger pad 38 and is supported by bracket 39 with pivot 37. It is spring loaded such that head 44 biased toward the position of FIG. 3.

Figure 2:
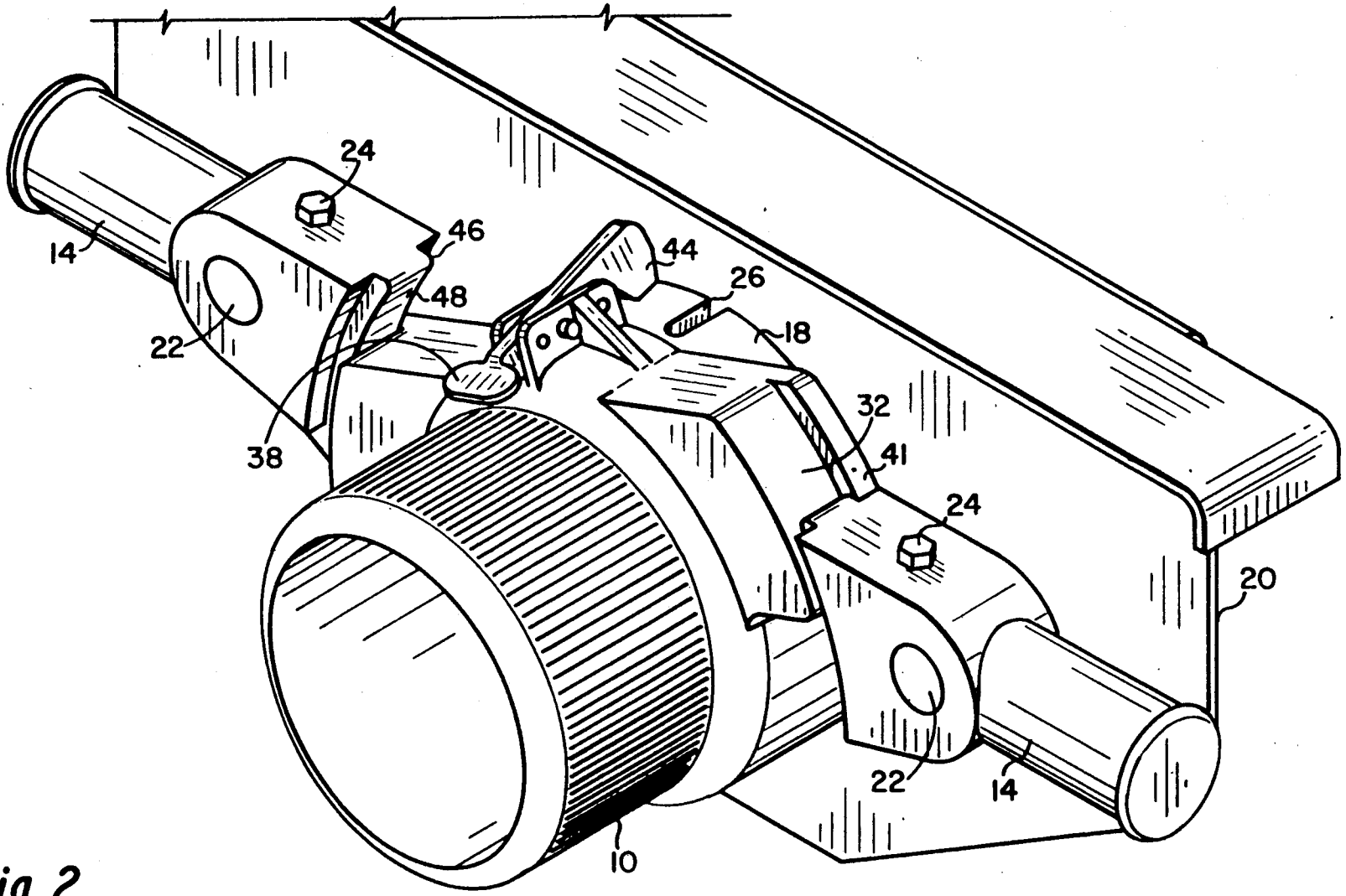
FIG. 2 is a front perspective view showing the cap in a partial turn position with the end cap locking lever not in engagement with the locking slot of the connection tube collar.

Attention is now directed to operating handles 14. Each handle has a locking lug 28 that has an arcuate concave surface 48 that, as will be seen in FIGS. 2 and 3, mates with locking convex surface 32 of end cap 10. When the handles are in the position shown in FIG. 1, arcuate concave surface 48 defines a cylinder having its axis coinciding with axial line 42. Handles 14 are placed on control rods 22 such that in this position the hopper gate is closed. Locking lug 28 has a shoulder 46 that locking lug 40 will contact when the end cap is rotated as shown in FIGS. 2 and 3. Connection tube collar 18 has a connection tube locking slot 26 to receive head 44 of the spring loaded locking lever 12, as illustrated in FIG. 3. Typically, concave surface 48 may have an arcuate angle of about 30 to 35 radial degrees, and locking convex surface 32 will generally have about the same arcuate angle as does concave surface 48.

We will next describe the placing of cap 10 from the position of FIG. 1 to that of FIG. 3. End cap 10 is rotated to approximate position such as shown in FIG. 1 so that it can be placed over connection tube 16 and placed against sealing ring 30. This is to permit end cap locking lugs 40 to avoid control handle lugs 28 and to be positioned in an axial position with seal 30 adjacent the end of end cap 10. When in this axial position, end cap 10 is rotated in either direction for about 40 degrees or enough so that rim 41 of lug 40 can engage shoulder 46 of locking lug 28. As can be seen in FIG. 2, end cap 10 has been pushed all the way against sealing ring 30 and has been rotated so that locking lugs 28 have at least partially engaged shoulders 46. This engagement (when complete, see FIG. 3) is to prevent axial movement of cap 10 with respect to connection tube 16. Also, concave surface 48 has engaged a portion of locking convex surface 32 of locking lug portion 40 of end cap 10. This engagement, (when complete, see FIG. 3) is to prevent rotation of control rod handles 14.

When in the position of FIG. 2, locking lever 12 is resting on the rim of collar 18. The operator continues to rotate the end cap until it reaches the position shown in FIG. 3, which may typically be about 40 degrees. This is progressed to the point where head 44 of locking lever 12 has engaged locking slot 26 that is on connection tube collar 18. This prevents the end cap from rotating with respect to the end collar or with respect to operating handle 14. At the same time, concave surface 48 of handles 14 is in relatively full contact with convex surface 32 of locking lug 40. This last engagement of the surfaces prevents handles 14 from being turned. Thus, control rods cannot turn and the gate will remain closed. Also, locking lug 40 on end cap 10 is in engagement with locking lug 28 or shoulder 46 that is on the side of the lug toward the panel. When in this position, it is clear that the locking cap cannot be moved axially due to the fact that spring loaded locking lever 12 is in slot 26, the cap cannot rotate and, thus, locking convex surface 32 of the cap will continue to engage the lug concave surfaces 48 of handles 14 and, thus, the handles cannot be rotated. When the end cap is in the locked position, as shown in FIG. 3, it functions (1) to close the end of connection tube 16 and (2) to prevent rotation of control rods 22. Cable seal holes 36A and 36B are in bracket 39 that holds spring loaded locking lever 12. Cable seals are widely used as means of locking a device in position to tell whether or not it has been tampered with. Thus, with the cable in seal hole 36 and sealed, locking lever 12 can not be released without breaking the seal. Two cable seal positions are provided for double locking of locking lever 12.

When it is time to unload a hopper the cable seal/-seals is first inspected and if found to be intact, it is then broken and the locking lever is released from slot 26 by pressing down on finger pad 38. The end cap is then rotated about 40 degrees or whatever is necessary so that locking lug 40 disengages locking lug 28 on operating handle 14. At this point, end cap 10 can be readily removed to the position shown in FIG. 1. At this time, operating handles 14 can be operated in the desired manner to open or close the valve or the hopper.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A system for use for unloading a gate on a container with a valve mechanism operated by a control rod extending through a panel which comprises:

a connection tube secured to said panel;

a rotating operating handle secured to a control rod for rotating said control rod;

an end cap for fitting over and closing said connection tube and in a fully closed position being rotatable on said connection tube; and said end caps having means for preventing rotation movement of said handle when said cap is placed over said connection tube to said fully closed position and is then rotated to a selected rotational position with respect to said connection tube.

2. A system as defined in claim 1 including means for securing said cap to said connection tube when said cap is in said fully closed position to close said connection tube and is in a locking rotational position to prevent rotation of said handle.

3. A system for use on unloading gates on a hopper or the like operated by control rods extending through a panel which comprises:

a connection tube which is secured to said panel;

an operating handle secured to one of said control rods, said handle having a locking lug with a concave locking surface;

an end cap for fitting over said connection tube and having an end cap locking rim with a convex locking surface, such that when said end cap is positioned over said connection tube and rotated to a selected position, said end cap locking rim convex surface engages said locking lug concave locking surface; and a locking means secured to said end cap for preventing rotation thereof when said end cap is positioned on said connection tube.

4. A system as defined in claim 3 in which there is a second control rod operating handle and a second locking lug on said second handle and a second convex locking surface on said end cap, wherein said second locking surface on said end cap engages the second locking lug on said second operating handle when said end cap is positioned over said connection tube and rotated to said selected position.

5. A system as defined in claim 4 in which said locking means is in the form of a locking lever that is spring loaded and is supported by a bracket from said end cap.

6. A system for use with unloading gates on a hopper car or truck operated by control rods extending through a panel which comprises:

a connection tube having a collar secured to said panel, there being an annular seal on said collar, the periphery of said collar containing a locking slot;

an end cap;

a bracket on said end cap;

a locking lever supported from said bracket and having a locking head which is biased to enter said locking slot on said collar when aligned therewith;

two spaced apart locking lugs secured to said end cap each of said locking lugs having a protruding locking rim and a locking convex surface;

at least two spaced apart operating handles each secured to a separate one of said control rods, each of said operating handles having a handle locking lug with a concave locking surface and a locking shoulder adjacent said concave locking surface; and wherein the locking rims of said end cap are sized to fit against th shoulders of said at least two handles on a side adjacent said panel so that said end cap when in this position cannot be axially moved and the locking lug convex surfaces of said end cap are of a size to closely match the size of said locking concave surfaces of said handle lugs so that said handles cannot rotate when said end cap is in this position, and further said locking lever of said end cap engages the locking slot of said connection tube collar and comprises means for preventing rotation of said cap with respect to said collar.

* * * * *